United States Patent [19]

Ogata et al.

[11] Patent Number: 5,019,191

[45] Date of Patent: May 28, 1991

[54] MAGNETIC STEEL PLATE FOR USE AS A MAGNETIC SHIELDING MEMBER AND A METHOD FOR THE MANUFACTURE THEREOF

[75] Inventors: Ryuji Ogata; Naokazu Nakano; Shuichi Suzuki, all of Ibaraki, Japan

[73] Assignee: Sumitomo Metal Industries, Ltd., Osaka, Japan

[21] Appl. No.: 454,279

[22] Filed: Dec. 21, 1989

[30] Foreign Application Priority Data

| | | | |
|---|---|---|---|
| Dec. 22, 1988 | [JP] | Japan | 63-325623 |
| Aug. 24, 1989 | [JP] | Japan | 1-218171 |
| Oct. 19, 1989 | [JP] | Japan | 1-272592 |

[51] Int. Cl.[5] ..... H01F 1/147

[52] U.S. Cl. ..... 148/307; 420/8; 420/89

[58] Field of Search ..... 148/307; 420/8, 89

[56] References Cited

FOREIGN PATENT DOCUMENTS

| | | | |
|---|---|---|---|
| 0053913 | 6/1982 | European Pat. Off. . | |
| 47-25247 | 7/1972 | Japan | 148/307 |
| 63-137138 | 6/1988 | Japan . | |

OTHER PUBLICATIONS

Methods of Ferrite Grain Size Test for Steel JIS G 0552 pp. 203 to 214.

*Primary Examiner*—John P. Sheehan

*Attorney, Agent, or Firm*—Burns, Doane, Swecker & Mathis

[57] ABSTRACT

A magnetic steel plate for use as a magnetic shielding member and a method for the manufacture thereof are disclosed, and the steel composition consists essentially of, by weight %;

C: not greater than 0.05%,

Si: greater than 0.30%, but not greater than 1.50%,

Mn: not greater than 0.50%, sol Al: less than 0.005%, with the balance being Fe and incidental impurities. The magnetic steel plate has a ferrite grain size of 0 (zero) or smaller.

14 Claims, 3 Drawing Sheets

MAGNETIC STEEL PLATE FOR USE AS A MAGNETIC SHIELDING MEMBER AND A METHOD FOR THE MANUFACTURE THEREOF

BACKGROUND OF THE INVENTION

This invention relates to magnetic steel plates exhibiting satisfactory magnetic properties, including magnetic plates which can be used for magnetic shielding from leakage magnetic flux. This invention also relates to a method of manufacturing such steel plates.

In recent years, many high-technology devices which utilize a strong magnetic field have been developed. One typical apparatus which uses very strong magnetic fields is a magnetic resonance imaging apparatus (hereunder referred to as an "MRI apparatus").

During the operation of an MRI apparatus there is a large amount of leakage magnetic flux. As the leakage magnetic flux can adversely affect electrical equipment outside the MRI apparatus, it is important to shield the surroundings from the leakage magnetic flux. There are two methods of providing magnetic shielding. One is to cover the MRI apparatus itself with magnetic shielding members, and the other is to surround the room where the MRI apparatus is installed with magnetic shielding members. In either method, the shielding members are usually steel plates with a high degree of magnetic permeability. Such steel plates are called magnetic leakage-shielding steel plates, and are also used as covering members and structural members of large-scale equipment for scientific research such as cyclotrons in order to carry out magnetic shielding.

Therefore, such magnetic steel plates must have satisfactory mechanical properties, and there is a strong need for a material which has not only good mechanical properties but also good magnetic properties such as permeability and magnetic flux density.

Soft magnetic steel plates have been used as magnetic flux-shielding members. The most-widely used one is a thin plate for use in transformers. The steel plates defined in JIS C 2504 are thin plates with a thickness of 0.6–4.5 mm. JIS C 2503 defines steel bars having a diameter of 1.0–16 mm.

There are also cases in which a steel plate such as S10C steel which is defined in JIS G 4051 as a mechanical structural carbon steel plate is employed as a magnetic steel.

In addition, Japanese Published Unexamined Patent Application No. 96749/1985, Japanese Published Examined Patent Application No. 45442/1988, and Japanese Published Examined Patent Application No. 45443/1988 disclose a thick steel plate for use in direct current magnetization, which contains a rather large amount of sol. Al, e.g. 0.005–1.00% of sol. Al and as little of Si as possible. This steel plate is made from a low carbon steel which has been deoxidized with Al.

However, the magnetic properties of these conventional magnetic steel plates are not adequate for the plates to shield the leakage flux such as is experienced in MRI apparatuses.

(i) Soft magnetic bars and plates such as defined in JIS C 2503 and 2504 are intended to be used as small-sized parts. They are not intended to be used as structural members and their mechanical properties are poor. Therefore, if such a magnetic plate is to be applied to an MRI apparatus, it is necessary to laminate about 10 steel sheets in order to obtain adequate rigidity. This manufacturing method is impractical because of high manufacturing costs and poor quality of the laminated product.

(ii) The carbon steels for mechanical and structural use which are defined in JIS G 4051 have a maximum permeability ($\mu_{max}$) of 1800 or smaller. This is because magnetic properties are not regarded as important for such materials.

The magnetic steel plate disclosed in Japanese Published Unexamined Patent Application No. 96749/1985 has a maximum permeability ($\mu_{max}$) which extends over a wide range of 12850 to 4260. The permeability of that steel is not adequate for the steel to be used as a magnetic steel plate for shielding the leakage magnetic flux from an MRI apparatus.

According to the methods disclosed in Japanese Published Examined Patent Application No. 45442/1988 and No. 45443/1988, it is possible to increase the maximum permeability ($\mu_{max}$) of a steel plate to 2000–5000. However, this level of permeability is inadequate for the steel plate to be used in an MRI apparatus.

Thus, it is not possible to obtain a satisfactory magnetic steel plate for use as a magnetic shielding member in devices such as MRI apparatuses.

SUMMARY OF THE INVENTION

The object of the present invention is to provide a magnetic steel plate for use as a magnetic shielding member and a method for the manufacture thereof, the steel plate having not only improved magnetic properties for shielding leakage magnetic flux but also good mechanical properties.

The inventors of the present invention found that a low carbon steel plate which has been deoxidized with Si has extremely good magnetic properties compared with a low carbon steel plate deoxidized with Al, which is disclosed in Japanese Published Unexamined Patent Application No. 96749/1985.

Thus, according to the findings of the present inventors, in order to provide a magnetic steel plate having improved magnetic properties it is important to minimize the content of elements which increase the demagnetizing factor. It is also important to increase the uniformity of magnetic properties in the thickness direction of the steel plate and for the steel to have extremely coarse crystal grains.

Elements which increase the demagnetizing factor include C, S, Cu, Cr, and sol. Al. Of these elements sol. Al has a great influence on magnetic properties, and it is desirable that the content of sol. Al be minimized. On the other hand, an example of an element which can increase permeability is Si, and it is possible to greatly improve the magnetic properties of a steel plate when a suitable amount of Si is added.

FIG. 1 is a graph showing the relationship between the content of sol. Al and the magnetic flux density at 1 Oe ($B_1$) for steels having substantially the same composition except for sol. Al. It can be seen from the graph that the content of sol. Al should be restricted to less than 0.005% in order to ensure $B_1 \geqq 10000$. The steel composition of FIG. 1 was C: 0.003%, Si: 0.60%, Mn: 0.09%, sol. Al: 0.002–0.021%, P: 0.006%, and S: 0.005%.

FIG. 2 is a graph showing the relationship between the content of Si and the magnetic property ($B_1$) as well as tensile strength (TS) of steels having substantially the same composition except for different amounts of Si. It can be seen from this graph that the content of Si should be restricted to greater than 0.30% in order to ensure that $B_1 \geqq 10000$ and $TS \geqq 35$ (kgf/mm$^2$). The steel composition was C: 0.003%, Si: 0.009–0.97%, Mn: 0.12%, sol. Al<0.003%, P: 0.006%, and S: 0.006%.

FIG. 3 is a graph showing the relationship between the content of Si and the magnetic property ($B_1$ and maximum permeability) for steels having substantially the same composition except for different amounts of Si. Substantially the same tendency as in FIG. 2 can be seen. The steel composition was the same as for FIG. 2.

In order to ensure uniformity of magnetic properties, it is important to decrease the content of elements which easily form non-metallic inclusions as well as elements which easily segregate. It is also helpful to make the size of crystal grains as uniform as possible in the thickness direction of the steel plate.

Furthermore, in order to make the crystal grains coarse, it is effective to impart strains to the crystal grains during hot working, and to heat the steel to a temperature not higher than the $Ac_1$ point after hot working.

According to the findings of the present inventors, it is also effective if after casting and hot working, the resulting steel plate is subjected to heat treatment at a temperature not lower than 700° C. or not lower than the $Ac_3$ point, i.e. the transformation temperature in order to adjust the crystal grain size, to remove strains induced by deformation, and to improve magnetic properties such as permeability without degrading mechanical properties.

Thus, the present invention is a magnetic steel plate for shielding magnetic flux which consists essentially of, by weight %;

C: not greater than 0.05%,

Si: greater than 0.30%, but not greater than 1.50%,

Mn: not greater than 0.50%, sol Al: less than 0.005%, and a balance of Fe and incidental impurities.

Preferably, the ferrite grain size number is 0 (zero) or smaller.

In another aspect, the present invention is a method of manufacturing a magnetic steel plate for shielding magnetic flux, which comprises heat treating, after hot working, a steel plate having the above-described composition in a temperature range of 700° C.—the $Ac_3$ point or in a temperature range of higher than the $Ac_3$ point.

The heating time is preferably defined by the following formula:

$$(273+T)(\log K+20) \geqq 22.9 \times 10^3$$

T: heat treating temperature (° C.), $T \geqq 700°$ C.

K: heating time (h), wherein $K \geqq t/25.4+0.1$

In a still another aspect, the present invention is a method of manufacturing a magnetic steel plate for shielding magnetic flux, which comprises hot working a steel having the above-described composition after heating it to the $Ac_3$ point or higher, finishing the hot working with a total reduction of 20% or larger in a temperature range of the $Ar_1$ point or lower temperatures, and heating, after cooling, the resulting steel plate to a temperature of from 850° C. to the $Ac_1$ point.

DESCRIPTION OF THE PREFERRED EMBODIMENTS

Figure 1:
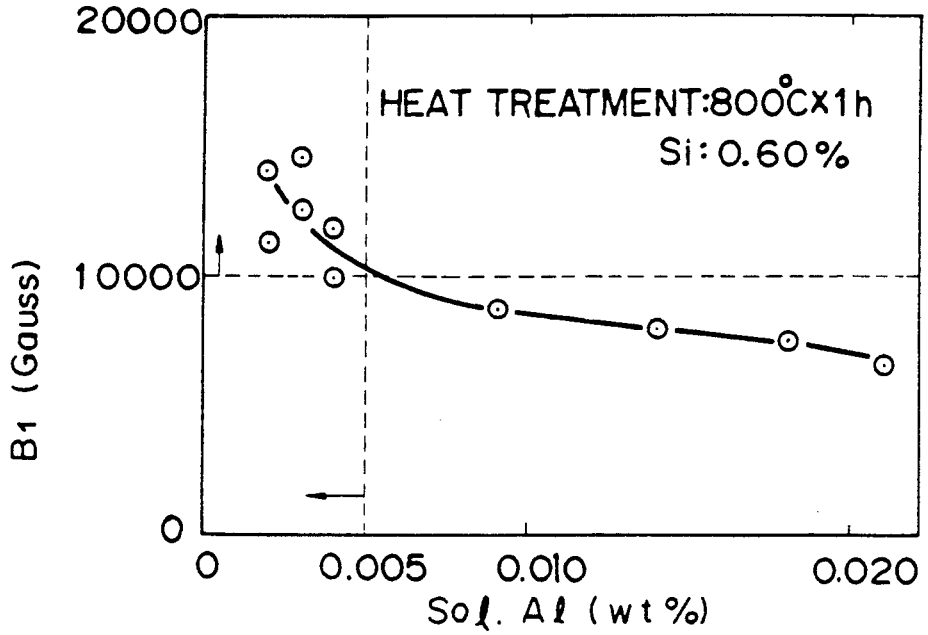
FIG. 1 is a graph showing the relationship between the content of sol. Al and magnetic flux density.
Figure 2:
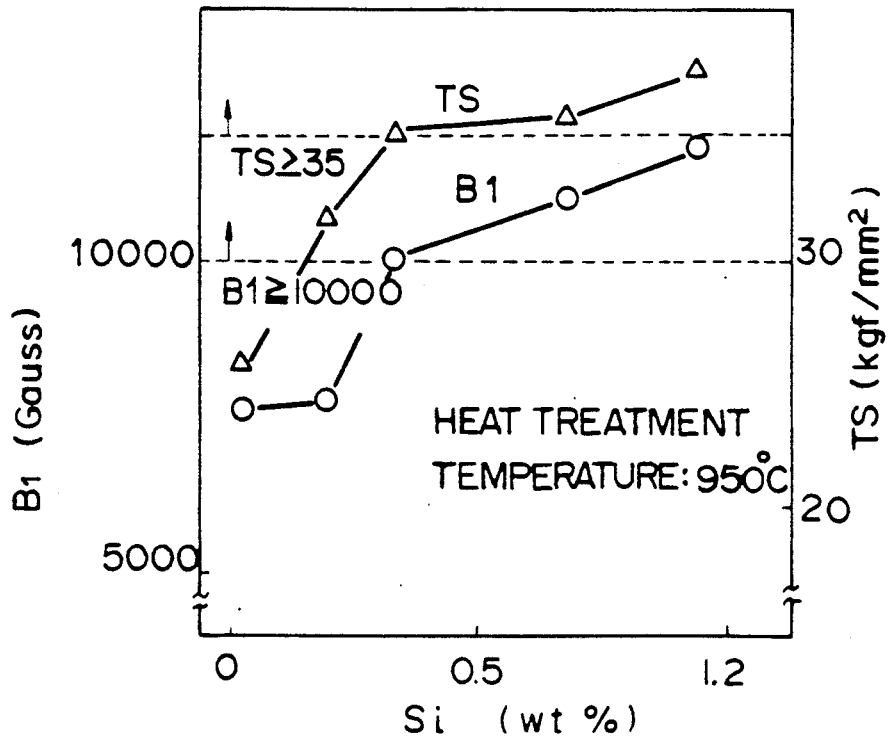
FIG. 2 is a graph showing the relationship between the content of Si and magnetic flux density in a magnetic field of 1 Oe ($B_1$) as well as tensile strength.
Figure 3:
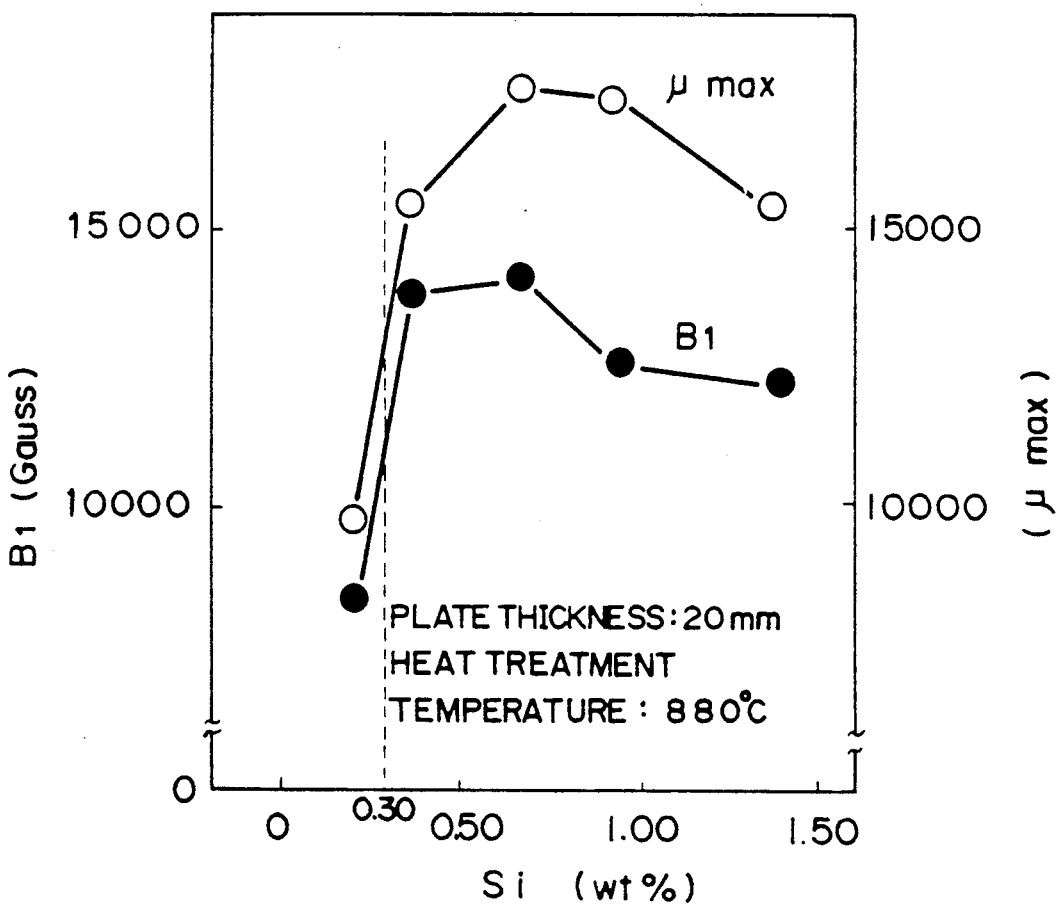
FIG. 3 is a graph showing the relationship between the content of Si and magnetic flux density as well as the maximum permeability.

The present invention will now be described in further detail. In the description, percent (%) refers to weight % unless otherwise indicated.

The reasons for the above-mentioned limits on the steel composition are as follows.

Carbon (C) greatly increases the demagnetizing factor of steel, so the content of C is preferably reduced to as low a level as possible. However, many steps are required to reduce the C content, resulting in an increase in manufacturing costs. Thus, according to the present invention the C content is restricted to not larger than 0.05%. Preferably it is 0.01% or smaller.

Silicon (Si) is a very important element to achieve the intended purpose of the present invention. The addition of Si promotes orientation of crystal grains and an improvement in magnetic properties. Si also serves as a deoxidizing agent. For these purposes the Si content is restricted to greater than 0.30%. However, the incorporation of an excess amount of Si makes the steel brittle, and the resulting steel cannot be used as a thick steel plate for structural use. Therefore, the Si content is restricted to greater than 0.30% but not greater than 1.50%. Preferably the Si content is greater than 0.30% but not greater than 1.0%.

Manganese (Mn) is an element which should not be present in large amounts because it adversely affects magnetization, as does carbon. However, when a thick steel plate is used as a structural member it is necessary to have not only satisfactory magnetic properties but also a minimum level of mechancial strength. Therefore, the upper limit of the Mn content is defined as 0.50%.

Aluminum (Al) is an extremely important element for achieving the purpose of the present invention. Al increases the demagnetizing factor, and it combines with N in steel to form aluminum nitrides which accelerate the formation of a mixed grain structure. Therefore, it is desirable to reduce the Al content. When the content of sol. Al is 0.005% or greater, both the maximum permeability and the magnetic flux density at a magnetic field of 1 Oe are decreased and satisfactory magnetic properties cannot be obtained. The sol. Al content is therefore restricted to less than 0.005% in the present invention.

P and S are included as impurities. Both P and S easily form non-metallic inclusions in steel, and so it is desirable to reduce the content of P and S. However, since it is very costly to do so, it is desirable in the present invention that the P content be defined as 0.10% or less and the S content be defined as 0.01% or less.

At least one additional element selected from the group consisting of Cr, Mo, Cu, N, and oxygen may be present in the above-described steel of the present invention. However, in order to attain satisfactory magnetic properties, it is desirable that the content of these elements be as low a level as possible.

Namely, since an element such as Cr, Mo, Cu and N increases the demagnetizing factor, and in particular, as mentioned above, nitrogen easily reacts with Al to form nitrides which promote refining of crystal grains, it is desirable that the content of these elements be minimized. This is also desirable in order to remove segregation of added elements. However, since it is impossible to avoid contamination of Cr, Mo, and Cu from refractory bricks during melting and refining, it is rather difficult to reduce the content of these elements to an extremely low level. Therefore, Cr may be present in an amount of 0.20% or less, Mo in an amount of 0.02% or less, Cu in an amount of 0.10% or less, and N in an amount of 0.01% or less.

Oxygen contained in steel easily forms non-metallic inclusions which segregate to prevent movement of magnetic domain walls. Thus, the more the oxygen content the more the coercive force with a fear of degradation of magnetic properties. So it is desirable to reduce the oxygen content as much as possible, i.e., 0.003% or less.

According to a preferred embodiment of the present invention the ferrite grain size number is restricted to zero or smaller. When the number is larger than zero, i.e., finer, both the maximum permeability ($\mu_{max}$) and the magnetic flux density ($B_1$) are decreased, and satisfactory magnetic properties cannot be obtained.

According to the present invention, it is desirable that the ferrite grain size number be determined by the intercept method which is defined in JIS G 0552 in which the number of ferritic grains cut by any segment of a line is determined and this number is converted into the number of ferrite grains within a 25×25 mm area in the field of view when the magnification is ×100. According to the present invention, the ferrite grains are greatly coarsened. Needless to say, the comparison method can be employed for this purpose. When the comparison method is employed, it is desirable that the ferrite grain size number be restricted to zero or smaller.

The magnetic steel plate of the present invention has very satisfactory magnetic properties. Of the magnetic properties which should be possessed by a magnetic steel plate for shielding leakage magnetic flux, the maximum permeability ($\mu_{max}$) and the magnetic flux density are critical. High-technology equipment now requires that the minimum level for the maximum permeability ($\mu_{max}$) be 10000 or larger, and preferably 30000 or larger, while the magnetic flux density ($B_1$) at a magnetic field of 1 Oe must be 10000 or higher, and preferably 14000 or higher. The properties of the magnetic steel plate of the present invention easily surpass such requirements.

Next, a method of manufacturing the magnetic steel plate for shielding leakage magnetic flux of the present invention will be further described.

Melting and refining can be carried out using either a converter or electric furnace. If necessary, refining with a ladle or refining by vacuum degassing may be employed so as to further remove elements which markedly increase the demagnetizing factor such as C, Al, Cr, Mo, Cu, and N. In order to minimize the formation of non-metallic inclusions as well as their segregation, P and S are also removed. Oxygen can be removed by the addition of Si.

The resulting slab steel is then subject to hot working. Pre-treatment or any other special treatments for the hot working are not always necessary, and the hot working may be carried out by either, rolling with a rolling mill or forging with a forging machine.

According to a preferred embodiment of the present invention, prior to the hot working, the steel is heated to a temperature higher than the $Ac_3$ point, and preferably higher than the $Ac_3$ point but lower than 1200° C. As a result of heating to a temperature higher than the $Ac_3$ point, the steel structure becomes a single austenitic structure on which hot working is carried out. During hot working, the temperature of the steel decreases so that the steel comprises an austenitic-ferritic dual phase. Strains are indroduced uniformly during hot working, and a desirble mixed grain structure can be obtained when the steel is subjected to the below-mentioned recrystallization. Therefore, the only necessary limit as to the heating temperature is that the heating temperature of the slab steel be the $Ac_3$ point or higher. Although an upper limit on the heating temperature is not mandatory, the upper limit is preferably 1200° C. from the viewpoint of practicality since there is a fear that damage to facilities such has damage to a refractory lining of the heating furnace when the heating temperature is higher than 1200° C.

After heating the slab steel to a temperature higher than the $Ac_3$ point, hot working is carried out to form a desired shape. According to a preferred embodiment of the present invention the hot working is carried out in such a manner that the reduction in a temperature range not exceeding the $Ar_1$ point is 20% or more. The reduction in a temperature range not exceeding the $Ar_1$ point is defined by the following equation in which $\Delta h$ is the difference between the initial thickness of the plate and the final thickness of the plate at the finishing point, and $\Delta h\alpha$ is the difference between the thickness of the plate at the $Ar_1$ point and the thickness at the finishing point:

$$\text{Reduction (\%)} = \frac{\Delta h\alpha}{\Delta h} \times 100$$

The reason for defining the temperature range as not exceeding the $Ar_1$ point is that a single ferrite phase is prepared so that the same amount of strain can be imparted uniformly to each of the ferrite grains.

The purpose of defining the reduction as 20% or more is to make sure that strains can be imparted to ferrite grains at the center of the thickness of the plate. From this viewpoint the higher the reduction the better. However, when the reduction in a temperature range not exceeding the $Ar_1$ point is higher than 70%, the reduction in a low temperature range increases, resulting in overloading of equipment such as a rolling mill. This creates the danger of premature damage or collapse of equipment. Thus, it is desirable that the reduction in a temperature range not exceeding the $Ar_1$ point be 70% or less. From the standpoint of the uniformity of the strains which are introduced into ferritic crystal grains, it is not necessary to set a lower limit on the temperature during hot working i.e. the hot working finishing temperature. However, when the hot working is continued at a temperature lower than 650° C., the rolling mill is subject to overloading, and the wear of components such as rolls is accelerated. Therefore, it is desirable that the lower limit of hot working temperature be defined as 650° C.

For the purpose of introducing a lot of strains into ferrite crystal grains uniformly it is preferable that a conventional high aspect ratio rolling method be employed.

There is no limit on the thickness of the magnetic steel plate of the present invention, but it is usually at least 20 mm since it is intended to be used as a structural plate.

After hot working, heat treatment is performed to further arrange the crystal grains and to remove hot work-induced strains with a resulting improvement in magnetic properties, such as permeability and flux density.

Namely, the hot worked steel plate may be directly heat treated, but if necessary it can be cooled to room temperature so as to remove hydrogen. In order to thoroughly remove hydrogen, it is desirable to cool the hot worked plate to a temperature of 300° C. or lower. By cooling to such a low level, it is possible to ensure sufficient time to effect removable of hydrogen.

At the next stage the steel plate is subjected to heat treatment for the purposes of orientation of grains and removal of strains. In particular, annealing is effective to further improve magnetic properties. It is desirable that the annealing temperature be restricted to a temperature not lower than 850° C. but not higher than the $Ac_1$ point in order to form a recrystallized texture structure with well-grown ferritic grains. When the steel plate is heated to a temperature higher than the $Ac_1$ point, the once-formed recrystallized texture is changed into a transformed texture structure with a remarkable degradation in magnetic properties. On the other hand, a temperature lower than 850° C. is not high enough to give a sufficient amount of energy to promote the growth of ferrite grains.

During annealing, it is preferable that the steel plate be heated for a period of time of t/25 hours or longer (t: thickness of final product, mm) in order to uniformly heat the steel plate to the center of its thickness. In general, it is preferable that annealing treatment be carried out at 880° C. for about one hour.

After the completion of annealing, the steel plate may be cooled by natural cooling, air cooling, slow cooling, water cooling, quenching, etc. with substantially no change in the properties of the final product. In the present invention there is no restriction on the cooling method.

According to another preferred embodiment of the present invention, the hot worked steel plate is heated at a temperature of 700° C. or higher for a given period of time so that satisfactory magnetic as well as mechanical properties can be obtained.

In this embodiment the length of the heating period (K) is given by the following formula:

$$K \geqq (t/25.4+0.1)$$

$$(273+T)(\log K+20) \geqq 22.9\times 10^3$$

wherein T stands for the heating temperature (° C.).

Thus, according to this embodiment when the steel plate is heated to a temperature not higher than the $Ac_3$ point, the resulting structure has a recrystallized texture and the grain growth is promoted to enlarge the magnetic domains, resulting in a remarkable improvement in magnetic properties.

However, in this embodiment, there is a slight degree of degradation in mechanical properties including toughness, and this process can be applied when such a degradation is tolerable.

On the other hand, if the steel plate is heated at a temperature higher than the $Ac_3$ point for the above-defined period (K), the resulting structure has a transformed texture with refined crystal grains. The magnetic properties are degraded to a slight extent, but the mechanical properties can be improved remarkably. Therefore, a relatively high heating temperature of greater than the $Ac_3$ point can be employed when the mechanical properties are particularly important.

The present invention will be further described in conjunction with the following working examples which are presented merely for illustrative purposes.

EXAMPLE 1

Slab steels having the compositions shown in Table 1 were prepared by carrying out melting and refining using an electric furnace.

The resulting slab steels were formed into given shapes, and annealing was performed under the conditions shown in Table 1.

Samples No. 1-13 were prepared from the annealed steels. The maximum permeability ($\mu_{max}$) and the magnetic flux density ($B_1$) of the samples in a magnetic field of 1 Oe were determined.

The test results are also shown in Table 1.

In Samples No. 1 through No. 3, the Si content was varied from 0.37% to 0.95% while the steel compositions were otherwise the same. The heat treatment conditions were also substantially the same for these Samples. The maximum permeability was 15300-17600, and the magnetic flux density was 12200-14000 (Gauss). These values are double or more those obtained in the prior art. These values increased as the Si content increased.

EXAMPLE 2

Slab steels having the compositions shown in Table 2 were obtained using an electric furnace melting method. From these slab steels, JIS No. 5 type test pieces were cut to make Samples No. 1-No. 4. The steel compositions of Samples No. 1-No. 3 corresponded to those of Table 1. The test results are also shown in Table 2.

As is apparent from Table 2, Samples No. 1 through No. 3 of the present invention had values much higher than in the prior art in respect to Y.P., T.S., and vEo. It is said that the T.S. should be higher than 25 kgf/mm$^2$ for a soft magnetic thick steel plate. The samples of the present invention had values much higher than 25 kgf/mm$^2$. Thus, the material of the present invention is strong enough to be used as a structural member for an MRI apparatus.

EXAMPLE 3

Steel A through Steel C having the compositions shown in Table 3 and having a thickness of 230 mm were heated to 1100°-1160° C., as shown in Table 4, and then hot rolling was carried out.

During hot rolling, the reduction in a temperature range not exceeding the $Ar_1$ point was adjusted to be 0-50% and the hot rolling was finished at 760°-911° C. followed by cooling to 150° C. to give a hot-rolled steel plate with a thickness of 20 mm.

The resulting steel plates were annealed by heating at 880° C. to obtain Samples No. 1 through No. 36 in Table 4.

The ferrite crystal grain size number of these samples was determined by means of the before-mentioned intercept method, and the maximum permeability. ($\mu_{max}$) and the magnetic flux density ($B_1$) were also determined.

Figure 4:
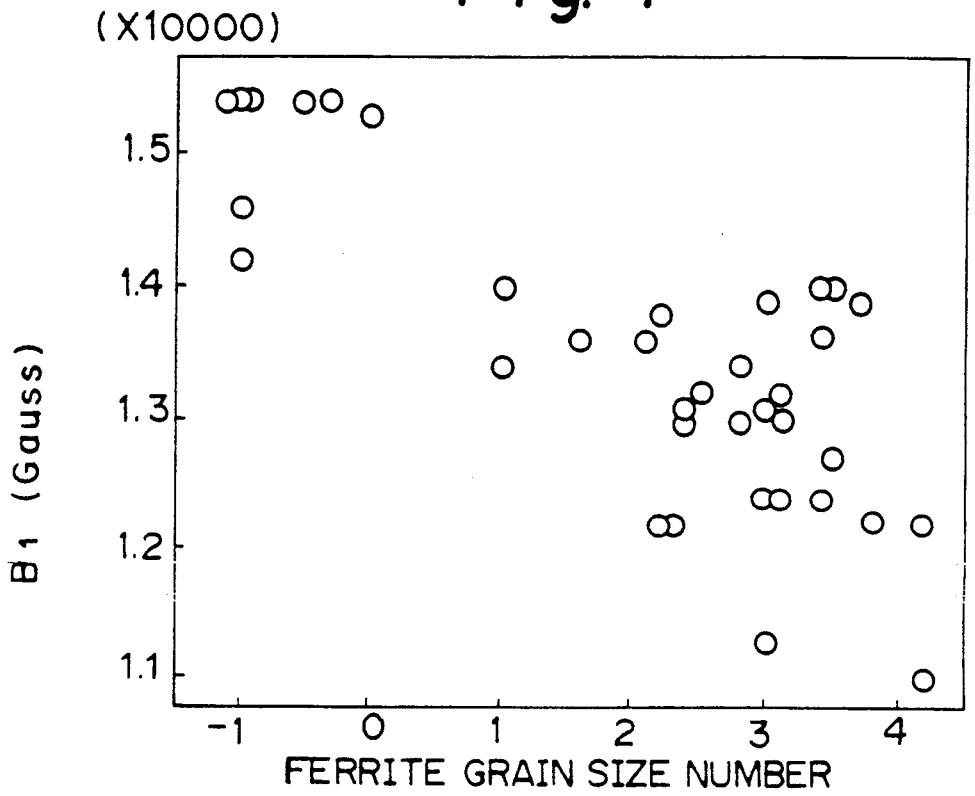
FIG. 4 is a graph showing the relationship between the magnetic flux density and the ferrite grain size number.
Figure 5:
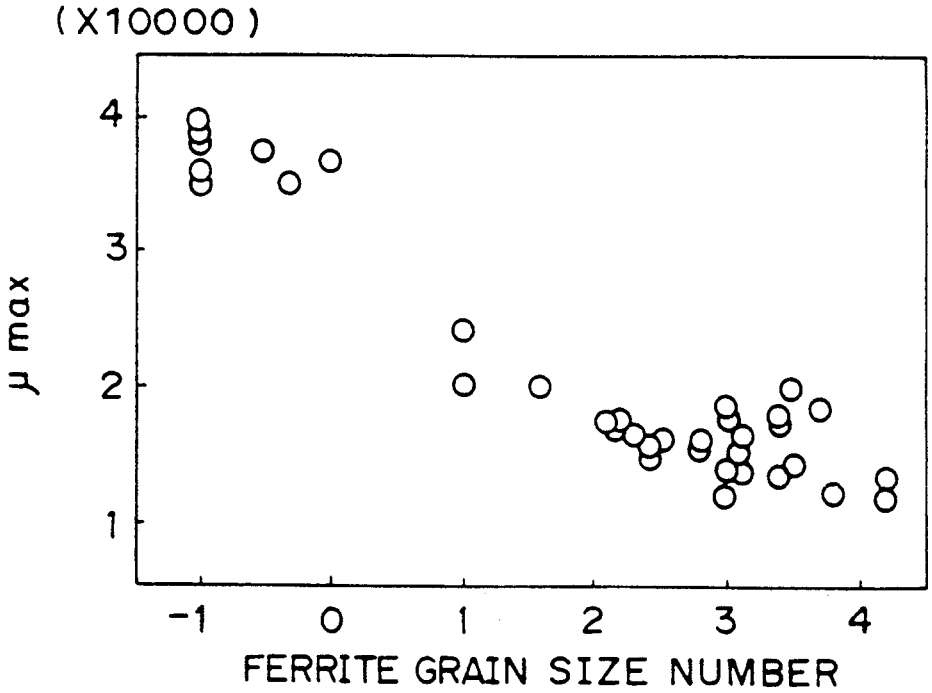
FIG. 5 is a graph showing the relationship between the maximum permeability and the ferrite grain size number.

The test results are shown in Table 4, and the relationship between the ferrite grain size number and $\mu_{max}$ is illustrated in FIG. 5. The relationship between the ferrite grain size number and $B_1$ is illustrated in FIG 4.

As is apparent from Table 4, FIG. 4, and FIG. 5, when the ferrite grain number is zero or smaller, $\mu_{max}$ is 30000 or larger and $B_1$ is 14000 or greater, as shown for Samples No. 1–No. 8. These high values indicate that the material of the present invention can exhibit excellent magnetic properties.

EXAMPLE 4

Slab steels having the compositions shown in Table 5 were heated to 1160° C. and then subjected to hot rolling. The hot rolling was carried out with the reduction shown in Table 5. After finishing hot rolling at the finishing temperature shown in Table 5, the resulting hot rolled steel plates were cooled to the temperatures indicated in Table 5 to produce hot rolled steel plates with a thickness of 20 mm or 80 mm. Thereafter, annealing was performed at the heating temperature and heating time indicated in Table 5, and after cooling to room temperature Samples No. 1 through No. 30 were obtained.

The following properties of the resulting steel plates were determined:

(i) Ferrite grain size number by the intercept method in accordance with JIS G 0552.

(ii) Maximum permeability ($\mu_{max}$) and magnetic flux density ($B_1$, Gauss) in a magnetic field of 1 Oe.

(iii) Average Charpy absorbed energy for V-notched test pieces at 0° C., $vEo^{-4VE}$ (kgf.m), and tensile strength, TS (kgf/mm$^2$).

The test results are shown in Table 5.

EXAMPLE 5

Slab steels having the compositions shown in Table 6 were formed into plates having a thickness of 20–160 mm. The resulting steel plates were then subjected to heat treatment under the conditions shown in Table 6 to produce the thick steel plates of Samples No. 1 to No. 21. The maximum permeability and the magnetic flux density at the magnetic field of 1 Oe ($B_1$, Gauss) were determined for each of the samples.

The test results are shown in Table 6.

The indication "Calculation" means values obtained by calculation of the left-hand side of the following formula:

$$(273+T)(\log K+20) \geqq 22.9\times 10^3$$

wherein $K=t/25.4+0.1$

The above note will apply to Tables 7 and 8.

EXAMPLE 6

In this example, slab steels having the compositions shown in Table 7 were hot worked in the same manner as in Example 5 to produce hot worked steel plates having a thickness of 20–160 mm. The resulting steel plates were subjected to heat treatment under the conditions shown in Table 7.

The magnetic and mechanical properties of the thus prepared samples of the present invention are shown in Table 7.

Table 8 shows experimental data of comparative samples having steel compositions falling outside the range of the present invention.

Samples No. 1 of Table 8 had a carbon content higher than that of the present invention. The maximum permeability and magnetic flux density were decreased.

Sample No. 2 of Table 8 shows the importance of the presence of Si. Its Si content was lower than that of the present invention. The maximum permeability and magnetic flux density were both decreased.

Sample No. 3 of Table 8 had an Al content higher than that of the present invention. The maximum permeability and magnetic flux density were greatly decreased.

Sample No. 4 of Table 8 has an Mn content higher than that of the present invention. Both the maximum permeability and magnetic flux density were decreased.

TABLE 1

| Sample | Steel composition (wt %) | | | | | | Heat Treatment | | Maximum Permea- | $B_1$ | |
|---|---|---|---|---|---|---|---|---|---|---|---|
| No. | C | Si | Mn | P | S | sol. Al | Temp. (°C.) | Time (h) | bility | (Gauss) | Remarks |
| 1 | 0.002 | 0.37 | 0.16 | 0.006 | 0.003 | 0.003 | 880 | 1 | 15300 | 12200 | Present |
| 2 | 0.003 | 0.68 | 0.12 | 0.007 | 0.007 | 0.002 | 880 | 1 | 17600 | 14000 | Invention |
| 3 | 0.004 | 0.95 | 0.12 | 0.006 | 0.006 | 0.003 | 880 | 1 | 17400 | 12600 | |
| 4 | 0.008 | 0.58 | 0.09 | 0.006 | 0.006 | 0.003 | 950 | 1 | 14500 | 11700 | |
| 5 | 0.004 | 0.62 | 0.10 | 0.032 | 0.004 | 0.002 | 950 | 1 | 14200 | 11200 | |
| 6 | 0.007 | 0.61 | 0.12 | 0.067 | 0.007 | 0.004 | 950 | 1 | 11400 | 10600 | |
| 7 | 0.010 | 0.58 | 0.09 | 0.082 | 0.007 | 0.004 | 950 | 1 | 10800 | 10000 | |
| 8 | 0.009 | 0.32 | 0.18 | 0.009 | 0.007 | 0.003 | 880 | 1 | 13700 | 11600 | |
| 9 | 0.004 | 0.63 | 0.47 | 0.007 | 0.004 | 0.002 | 950 | 1 | 10200 | 10000 | |
| 10 | 0.06* | 0.60 | 0.12 | 0.026 | 0.008 | 0.002 | 880 | 1 | 6800 | 5700 | Com- |
| 11 | 0.006 | 0.21* | 0.09 | 0.009 | 0.007 | 0.002 | 880 | 1 | 9700 | 8200 | parative |
| 12 | 0.003 | 0.65 | 0.11 | 0.007 | 0.006 | 0.021* | 880 | 1 | 7100 | 6700 | |
| 13 | 0.006 | 0.62 | 0.72* | 0.006 | 0.003 | 0.004 | 880 | 1 | 4800 | 4400 | |

Note: *Outside the range of the present invention

TABLE 2

| Sample | Steel Composition (wt %) | | | | | | Y.P. | T.S. | $vE_0$ | |
|---|---|---|---|---|---|---|---|---|---|---|
| No. | C | Si | Mn | P | S | sol. Al | (kgf/mm$^2$) | (kgf/mm$^2$) | (kgf · m) | Remarks |
| 1 | 0.002 | 0.37 | 0.16 | 0.006 | 0.003 | 0.003 | 19.6 | 31.8 | 31.2 | Present |
| 2 | 0.003 | 0.68 | 0.12 | 0.007 | 0.007 | 0.002 | 20.2 | 32.7 | 33.4 | Invention |
| 3 | 0.004 | 0.95 | 0.12 | 0.006 | 0.006 | 0.003 | 22.3 | 35.8 | 36.2 | |
| 4 | 0.002 | 0.004* | 0.09 | 0.005 | 0.004 | 0.003 | 12.3 | 24.5 | 22.8 | Com- |

TABLE 2-continued

| Sample No. | Steel Composition (wt %) C | Si | Mn | P | S | sol. Al | Y.P. (kgf/mm²) | T.S. (kgf/mm²) | vE0 (kgf · m) | Remarks |
|---|---|---|---|---|---|---|---|---|---|---|
| | | | | | | | | | | parative |

Note: *Outside the range of the present invention

TABLE 3

| Steel | Steel Composition (wt %) C | Si | Mn | P | S | sol. Al | Cr | Mo | Cu | N | O | Transformation Temp. Ar1 Point (°C.) | Ac1 Point (°C.) | Ac3 Point (°C.) |
|---|---|---|---|---|---|---|---|---|---|---|---|---|---|---|
| A | 0.003 | 0.68 | 0.12 | 0.007 | 0.007 | 0.002 | 0.05 | 0.01 | 0.01 | 0.0038 | 0.0016 | 856 | 907 | 926 |
| B | 0.004 | 0.59 | 0.14 | 0.005 | 0.003 | 0.001 | 0.20 | 0.05 | 0.18 | 0.0047 | 0.0018 | 853 | 906 | 921 |
| C | 0.003 | 0.62 | 0.47 | 0.004 | 0.006 | 0.002 | 0.06 | 0.01 | 0.01 | 0.0027 | 0.0022 | 861 | 904 | 916 |

TABLE 4

| Sample No. | Steel | Heating Temp. (°C.) | Initial Temp. (°C) | *1 (%) | Finishing Temp. (°C.) | Cooling Temp. (°C.) | Heating Temp. (°C.) | Heating Time (min) | Ferrite Grain Size Number | Maximum Perme-ability | B1 (Gauss) |
|---|---|---|---|---|---|---|---|---|---|---|---|
| 1 | A | 1160 | 1148 | 50 | 768 | 150 | 880 | 60 | −1.0 | 35200 | 14600 |
| 2 | A | 1140 | 1136 | " | 764 | " | " | " | −1.0 | 40000 | 15400 |
| 3 | A | 1120 | 1112 | 30 | 760 | " | " | " | −0.3 | 35200 | 15400 |
| 4 | B | 1140 | 1132 | 50 | 763 | " | " | " | −0.5 | 37600 | 15400 |
| 5 | B | 1120 | 1108 | 30 | 761 | " | " | " | 0 | 37000 | 15300 |
| 6 | B | 1100 | 1093 | " | 760 | " | " | " | −1.0 | 37200 | 15400 |
| 7 | C | 1160 | 1157 | 50 | 766 | " | " | " | −1.0 | 36000 | 14200 |
| 8 | C | 1140 | 1135 | 30 | 764 | " | " | " | −1.0 | 39200 | 15400 |
| 9 | A | 1160 | 1157 | 15 | 825 | " | " | " | 1.0 | 24200 | 14000 |
| 10 | B | " | 1156 | " | 815 | " | " | " | 1.0 | 20000 | 13400 |
| 11 | C | " | 1156 | " | 817 | " | " | " | 1.6 | 20000 | 13600 |
| 12 | A | " | 1151 | 10 | 806 | " | " | " | 2.1 | 17400 | 13600 |
| 13 | A | " | 1157 | " | " | " | " | " | 2.2 | 17400 | 13800 |
| 14 | B | " | 1152 | " | 800 | " | " | " | 2.2 | 17200 | 12200 |
| 15 | B | " | 1156 | " | " | " | " | " | 2.3 | 16200 | 12200 |
| 16 | C | " | 1155 | " | 855 | " | " | " | 2.4 | 15600 | 13100 |
| 17 | C | " | 1153 | " | " | " | " | " | 2.4 | 15200 | 13000 |
| 18 | A | " | 1156 | 0 | 860 | " | " | " | 2.5 | 16000 | 13200 |
| 19 | B | " | 1151 | " | 867 | " | " | " | 2.8 | 15400 | 13000 |
| 20 | C | " | 1154 | " | 865 | " | " | " | 2.8 | 16000 | 13400 |
| 21 | A | 1160 | 1156 | 0 | 888 | 150 | 880 | 60 | 3.0 | 14100 | 12400 |
| 22 | A | " | 1155 | " | 876 | " | " | " | 3.0 | 12000 | 11300 |
| 23 | B | " | 1154 | " | 884 | " | " | " | 3.0 | 18500 | 13900 |
| 24 | B | " | 1156 | " | 882 | " | " | " | 3.0 | 17700 | 13100 |
| 25 | A | " | 1157 | " | 891 | " | " | " | 3.1 | 15400 | 13200 |
| 26 | B | " | 1153 | " | 896 | " | " | " | 3.1 | 13800 | 12400 |
| 27 | C | " | 1154 | " | 893 | " | " | " | 3.1 | 16400 | 13000 |
| 28 | A | " | 1154 | " | 894 | " | " | " | 3.4 | 17400 | 14000 |
| 29 | B | " | 1152 | " | 894 | " | " | " | 3.4 | 18000 | 13600 |
| 30 | C | " | 1155 | " | 901 | " | " | " | 3.4 | 13300 | 12400 |
| 31 | A | " | 1157 | " | 907 | " | " | " | 3.5 | 14200 | 12700 |
| 32 | B | " | 1153 | " | 906 | " | " | " | 3.5 | 20000 | 14000 |
| 33 | A | " | 1154 | " | 904 | " | " | " | 3.7 | 18600 | 13900 |
| 34 | B | " | 1154 | " | 902 | " | " | " | 3.8 | 12200 | 12200 |
| 35 | A | " | 1157 | " | 911 | " | " | " | 4.2 | 13300 | 12200 |
| 36 | A | " | 1152 | " | 908 | " | " | " | 4.2 | 11500 | 11000 |

Note: *1 Reduction within a Temperature Range of ≦ Ar1 Point

TABLE 5

| Sample No. | Steel Composition (wt %) C | Si | Mn | P | S | sol. Al | Transformation Temp. $Ar_1$ Point (°C.) | $Ac_1$ Point (°C.) | $Ac_3$ Point (°C.) | Heating Temp. (°C.) | *1 (%) | Finishing Temp. (°C.) | Cooling Temp. (°C.) | Plate Thickness (mm) | Heat Treatment Temp. (°C.) | Heat Treatment Time (h) | Ferrite Grain Size Number | Magnetic Properties μ max | Magnetic Properties $B_1$ (Gauss) | Mechanical Properties $vE_0^{4ve}$ (kgf·m) | Mechanical Properties T.S. (kgf/mm²) | Remarks |
|---|---|---|---|---|---|---|---|---|---|---|---|---|---|---|---|---|---|---|---|---|---|---|
| 1 | 0.002 | 0.37 | 0.16 | 0.006 | 0.003 | 0.003 | 844 | 898 | 907 | 1160 | 50 | 740 | Room Temp. (24° C.) | 80 | 850 | 4 | −0.1 | 34000 | 14400 | 12.1 | 34.1 | Present Invention |
| 2 | " | " | " | " | " | " | " | " | " | " | " | " | Room Temp. (24° C.) | " | 880 | " | 0 | 34800 | 14700 | 11.8 | 34.2 | |
| 3 | 0.003 | 0.68 | 0.12 | 0.007 | 0.007 | 0.002 | 856 | 907 | 926 | " | " | " | Room Temp. (24° C.) | 20 | 850 | " | 0 | 37700 | 14800 | 11.9 | 32.4 | |
| 4 | " | " | " | " | " | " | " | " | " | " | " | " | Room Temp. (24° C.) | " | 880 | " | −0.3 | 39800 | 15100 | 11.4 | 33.8 | |
| 5 | " | " | " | " | " | " | " | " | " | " | " | " | Room Temp. (24° C.) | " | 900 | " | −1.0 | 40000 | 15200 | 10.1 | 33.6 | |
| 6 | 0.004 | 0.59 | 0.14 | 0.005 | 0.003 | 0.001 | 853 | 906 | 921 | " | 30 | " | Room Temp. (24° C.) | 80 | 850 | " | −0.8 | 36600 | 14800 | 10.2 | 33.1 | |
| 7 | " | " | " | " | " | " | " | " | " | " | " | " | Room Temp. (24° C.) | " | 880 | " | −1.0 | 36800 | 15500 | 12.1 | 33.6 | |
| 8 | " | " | " | " | " | " | " | " | " | " | " | " | Room Temp. (24° C.) | " | 900 | " | −1.5 | 40000 | 15400 | 10.4 | 33.4 | |
| 9 | 0.004 | 0.95 | 0.12 | 0.005 | 0.003 | 0.001 | 878 | 923 | 937 | " | 60 | " | Room Temp. (24° C.) | " | 850 | " | 0 | 32200 | 14100 | 9.8 | 35.1 | |
| 10 | " | " | " | " | " | " | " | " | " | " | " | " | Room Temp. (24° C.) | " | 880 | " | −1.0 | 38200 | 15400 | 10.6 | 33.1 | |
| 11 | " | " | " | " | " | " | " | " | " | " | " | " | Room Temp. (24° C.) | " | 900 | " | −1.6 | 41200 | 15400 | 10.4 | 33.8 | |
| 12 | 0.003 | 1.42 | 0.13 | 0.004 | 0.003 | 0.001 | 881 | 931 | 947 | " | 50 | 780 | Room Temp. (24° C.) | " | 880 | " | −0.7 | 37300 | 14300 | 10.1 | 34.1 | |
| 13 | " | " | " | " | " | " | " | " | " | " | " | " | Room Temp. (24° C.) | " | 900 | " | −1.1 | 39500 | 14700 | 10.3 | 34.8 | |
| 14 | " | " | " | " | " | " | " | " | " | " | " | " | Room Temp. (24° C.) | " | 920 | " | −1.3 | 41800 | 15100 | 8.7 | 34.3 | |
| 15 | 0.003 | 0.62 | 0.47 | 0.004 | 0.006 | 0.002 | 861 | 904 | 916 | " | " | 740 | Room Temp. (24° C.) | " | 850 | " | −1.1 | 31100 | 14200 | 21.8 | 37.7 | |
| 16 | " | " | " | " | " | " | " | " | " | " | " | " | Room Temp. | " | 880 | " | −0.4 | 34300 | 14300 | 20.4 | 36.2 | |

TABLE 5-continued

| Sample No. | Steel Composition (wt %) C | Si | Mn | P | S | sol. Al | Transformation Temp. $Ar_1$ Point (°C.) | $Ac_1$ Point (°C.) | $Ac_3$ Point (°C.) | Heating Temp. (°C.) | *1 (%) | Finishing Temp. (°C.) | Cooling Temp. (°C.) | Plate Thickness (mm) | Heat Treatment Temp. (°C.) | Time (h) | Ferrite Grain Size Number | Magnetic Properties $\mu$ max | $B_1$ (Gauss) | Mechanical Properties $vE_0^{Ave}$ (kgf·m) | T.S. (kgf/mm$^2$) | Remarks |
|---|---|---|---|---|---|---|---|---|---|---|---|---|---|---|---|---|---|---|---|---|---|---|
| 17 | " | " | " | " | " | " | " | " | " | " | " | " | (24° C.) Room Temp. | " | 900 | " | −0.4 | 37700 | 14900 | 17.7 | 36.8 | |
| 18 | 0.002 | 0.37 | 0.16 | 0.006 | 0.003 | 0.003 | 844 | 898 | 907 | 1160 | 0 | 870 | (24° C.) Room Temp. | 20 | 880 | 1 | 2.4 | 15300 | 13800 | 31.2 | 31.8 | |
| 19 | " | " | " | " | " | " | " | " | " | " | 12 | 820 | (24° C.) Room Temp. | " | " | 1 | 1.8 | 16800 | 13900 | 29.9 | 31.4 | |
| 20 | 0.003 | 0.68 | 0.12 | 0.007 | 0.007 | 0.002 | 856 | 907 | 926 | " | 0 | 910 | (24° C.) Room Temp. | " | " | 1 | 2.2 | 17600 | 14000 | 33.4 | 32.7 | |
| 21 | " | " | " | " | " | " | " | " | " | " | 12 | 820 | (24° C.) Room Temp. | " | " | 1 | 1.7 | 18800 | 14200 | 31.1 | 32.6 | |
| 22 | " | " | " | " | " | " | " | " | " | " | 50 | 740 | (24° C.) Room Temp. | 80 | 950 | 4 | 2.8 | 16600 | 12300 | 32.9 | 32.4 | |
| 23 | 0.007 | 0.61 | 0.13 | 0.006 | 0.003 | 0.001 | 852 | 904 | 927 | " | 0 | 910 | (24° C.) Room Temp. | " | 880 | 4 | 2.3 | 15400 | 13200 | 28.8 | 32.2 | |
| 24 | " | " | " | " | " | " | " | " | " | " | 0 | 910 | (24° C.) Room Temp. | " | 950 | 4 | 3.2 | 13800 | 12400 | 33.8 | 35.8 | |
| 25 | 0.004 | 0.95 | 0.12 | 0.005 | 0.003 | 0.001 | 878 | 923 | 937 | " | 0 | 910 | (24° C.) Room Temp. | 20 | 880 | 2 | 3.2 | 13200 | 11800 | 31.1 | 34.9 | |
| 26 | " | " | " | " | " | " | " | " | " | " | 10 | 800 | (24° C.) Room Temp. | 80 | " | 4 | 2.6 | 14100 | 14000 | 30.2 | 34.4 | |
| 27 | 0.003 | 1.42 | 0.13 | 0.004 | 0.003 | 0.001 | 881 | 931 | 947 | " | 0 | 910 | (24° C.) Room Temp. | 20 | " | 1 | 4.2 | 12800 | 11400 | 35.1 | 37.7 | |
| 28 | 0.06* | 0.60 | 0.12 | 0.026 | 0.008 | 0.002 | 796 | 824 | 909 | " | 50 | 740 | (24° C.) Room Temp. | " | 880 | 1 | 4.4 | 7900 | 6200 | 6.6 | 41.2 | Comparative |
| 29 | 0.003 | 0.65 | 0.11 | 0.007 | 0.006 | 0.021* | 849 | 902 | 925 | " | " | " | (24° C.) Room Temp. | " | 880 | 1 | 6.2 | 7100 | 6700 | 24.5 | 34.1 | |
| 30 | 0.006 | 0.62 | 0.72* | 0.006 | 0.003 | 0.004 | 844 | 897 | 911 | " | " | " | (24° C.) Room Temp. | " | " | 1 | 5.9 | 6900 | 6800 | 12.2 | 40.2 | |

Note: *Outside the range of the present invention
*1 Reduction within a Temperature Range of ± $Ar_1$ Point

TABLE 6

| Sample No. | Steel Composition (wt %) C | Si | Mn | P | S | sol. Al | Heat Treatment Temp. (°C.) | Time (h) | Magnetic Properties μ max | $B_1$ (Gauss) | Mechanical Properties $vE_0^{-1ve}$ (kgf·m) | T.S. (kgf/mm²) | $Ac_3$ (°C.) | Plate Thickness (mm) | Calculation (×10³) | Remarks |
|---|---|---|---|---|---|---|---|---|---|---|---|---|---|---|---|---|
| 1 | 0.002 | 0.37 | 0.16 | 0.006 | 0.003 | 0.003 | 950 | 1 | 10700 | 10100 | 30.8 | 35.2 | 907 | 20 | 24.5 | Present Invention |
| 2 | 0.003 | 0.68 | 0.12 | 0.007 | 0.007 | 0.002 | 950 | 1 | 12200 | 11000 | 30.6 | 35.7 | 926 | 20 | " | |
| 3 | 0.004 | 0.95 | 0.12 | 0.006 | 0.006 | 0.003 | 950 | 1 | 12800 | 11800 | 30.8 | 37.6 | 937 | 20 | " | |
| 4 | 0.008 | 0.58 | 0.09 | 0.006 | 0.006 | 0.003 | 950 | 1 | 12400 | 11400 | 31.3 | 35.8 | 920 | 160 | " | |
| 5 | 0.004 | 0.62 | 0.10 | 0.032 | 0.006 | 0.003 | 950 | 1 | 12000 | 11200 | 30.7 | 36.6 | 925 | 80 | " | |
| 6 | 0.007 | 0.61 | 0.12 | 0.062 | 0.007 | 0.004 | 950 | 1 | 11400 | 10600 | 33.6 | 36.2 | 927 | 80 | " | |
| 7 | 0.010 | 0.58 | 0.09 | 0.082 | 0.007 | 0.003 | 950 | 1 | 10800 | 10000 | 32.9 | 36.6 | 929 | 80 | " | |
| 8 | 0.009 | 0.32 | 0.18 | 0.009 | 0.007 | 0.003 | 950 | 1 | 10800 | 10200 | 30.6 | 35.1 | 907 | 20 | " | |
| 9 | 0.004 | 0.63 | 0.47 | 0.007 | 0.004 | 0.002 | 950 | 1 | 11100 | 10800 | 33.3 | 39.2 | 916 | 20 | " | |
| 10 | 0.018 | 0.61 | 0.09 | 0.018 | 0.005 | 0.003 | 950 | 1 | 11200 | 10800 | 33.5 | 39.7 | 920 | 20 | " | |
| 11 | 0.004 | 0.95 | 0.12 | 0.006 | 0.006 | 0.003 | 920 | 1 | 18400 | 14400 | 27.7 | 32.2 | 937 | 20 | 23.9 | |
| 12 | 0.008 | 0.58 | 0.09 | 0.006 | 0.006 | 0.003 | 900 | 1 | 16400 | 13800 | 32.6 | 31.7 | 920 | 160 | 23.5 | |
| 13 | 0.004 | 0.62 | 0.10 | 0.032 | 0.006 | 0.003 | 900 | 1 | 16100 | 13200 | 27.8 | 30.8 | 925 | 80 | " | |
| 14 | 0.007 | 0.61 | 0.12 | 0.062 | 0.007 | 0.004 | 900 | 1 | 16200 | 13400 | 27.4 | 31.1 | 927 | 80 | " | |
| 15 | 0.010 | 0.58 | 0.09 | 0.082 | 0.007 | 0.003 | 900 | 1 | 15800 | 13100 | 28.1 | 31.1 | 929 | 80 | " | |
| 16 | 0.009 | 0.32 | 0.18 | 0.009 | 0.007 | 0.003 | 900 | 1 | 12300 | 12100 | 30.6 | 31.0 | 907 | 20 | " | |
| 17 | 0.004 | 0.63 | 0.47 | 0.007 | 0.004 | 0.002 | 900 | 1 | 12100 | 12000 | 30.4 | 34.4 | 916 | 20 | " | |
| 18 | 0.018 | 0.61 | 0.09 | 0.018 | 0.005 | 0.003 | 900 | 1 | 12100 | 12000 | 31.8 | 34.7 | 920 | 20 | " | |
| 19 | 0.006 | 0.21* | 0.09 | 0.009 | 0.007 | 0.002 | 950 | 1 | 9400 | 7800 | 18.9 | 31.7 | 905 | 20 | 24.5 | Comparative |
| 20 | 0.003 | 0.65 | 0.11 | 0.007 | 0.006 | 0.021* | 950 | 1 | 7000 | 6800 | 29.4 | 36.6 | 925 | 20 | " | |
| 21 | 0.006 | 0.62 | 0.72* | 0.006 | 0.003 | 0.004 | 950 | 1 | 7600 | 7400 | 30.1 | 35.8 | 911 | 20 | " | |

Note: *Outside the range of the present invention

TABLE 7

| Sample No. | Steel Composition (wt %) C | Si | Mn | P | S | sol. Al | Heat Treatment Temp. (°C.) | Time (h) | Magnetic Properties μ max | $B_1$ (Gauss) | Mechanical Properties $vE_0^{-1ve}$ (kgf·m) | T.S. (kgf/mm²) | $Ac_3$ (°C.) | Plate Thickness (mm) | Calculation (×10³) | Remarks |
|---|---|---|---|---|---|---|---|---|---|---|---|---|---|---|---|---|
| 1 | 0.002 | 0.37 | 0.16 | 0.006 | 0.003 | 0.003 | 700 | 5 | 13200 | 12100 | 32.1 | 34.2 | 907 | 20 | 20.1 | Present Invention |
| 2 | " | " | " | " | " | " | 800 | 2 | 14100 | 12800 | 32.3 | 33.7 | " | " | 21.7 | |
| 3 | " | " | " | " | " | " | 850 | 1 | 14700 | 13500 | 32.1 | 31.9 | " | " | 22.5 | |
| 4 | " | " | " | " | " | " | 880 | 1 | 15300 | 13800 | 31.2 | 31.8 | " | " | 23.1 | |
| 5 | 0.003 | 0.68 | 0.12 | 0.007 | 0.007 | 0.002 | 800 | 1 | 14700 | 13100 | 33.3 | 33.8 | 926 | 20 | 21.7 | |
| 6 | " | " | " | " | " | " | 880 | 1 | 17600 | 14000 | 33.4 | 32.7 | " | " | 23.1 | |
| 7 | " | " | " | " | " | " | 900 | 1 | 17800 | 14700 | 31.6 | 31.1 | " | " | 23.5 | |
| 8 | 0.004 | 0.95 | 0.12 | 0.006 | 0.006 | 0.003 | 850 | 1 | 15700 | 12300 | 30.7 | 34.1 | 937 | 20 | 22.5 | |
| 9 | " | " | " | " | " | " | 880 | 1 | 17400 | 12600 | 31.3 | 33.8 | " | " | 23.1 | |
| 10 | " | " | " | " | " | " | 920 | 1 | 18400 | 14400 | 27.7 | 32.2 | " | " | 23.9 | |
| 11 | 0.008 | 0.58 | 0.09 | 0.006 | 0.006 | 0.003 | 850 | 1 | 15200 | 12700 | 32.3 | 32.9 | 920 | 160 | 22.5 | |
| 12 | " | " | " | " | " | " | 900 | 1 | 16400 | 13800 | 32.6 | 31.7 | " | " | 23.5 | |
| 13 | 0.004 | 0.62 | 0.10 | 0.032 | 0.006 | 0.003 | 850 | 1 | 14900 | 12600 | 28.2 | 32.4 | 925 | 80 | 22.5 | |
| 14 | " | " | " | " | " | " | 900 | 1 | 16100 | 13200 | 27.8 | 30.8 | " | " | 23.5 | |
| 15 | 0.007 | 0.61 | 0.12 | 0.062 | 0.007 | 0.004 | 850 | 1 | 14800 | 12700 | 27.8 | 32.7 | 927 | 80 | 22.5 | |
| 16 | " | " | " | " | " | " | 900 | 1 | 16200 | 13400 | 27.4 | 31.1 | " | " | 23.5 | |
| 17 | 0.010 | 0.58 | 0.09 | 0.082 | 0.007 | 0.003 | 850 | 1 | 14400 | 12800 | 27.8 | 32.2 | 929 | 80 | 22.5 | |
| 18 | " | " | " | " | " | " | 900 | 1 | 15800 | 13100 | 28.1 | 31.1 | " | " | 23.5 | |
| 19 | 0.009 | 0.32 | 0.18 | 0.009 | 0.007 | 0.003 | 900 | 1 | 12300 | 12100 | 30.6 | 31.0 | 907 | 20 | " | |
| 20 | 0.004 | 0.63 | 0.47 | 0.007 | 0.004 | 0.002 | 900 | 1 | 12100 | 12000 | 30.4 | 34.4 | 916 | 20 | " | |
| 21 | 0.018 | 0.61 | 0.09 | 0.018 | 0.005 | 0.003 | 900 | 1 | 12100 | 12000 | 31.8 | 34.7 | 920 | 20 | " | |

TABLE 8

| Sample No. | Steel Composition (wt %) C | Si | Mn | P | S | sol. Al | Heat Treatment Temp. (°C.) | Time (h) | Magnetic Properties μ max | $B_1$ (Gauss) | Mechanical Properties $vE_0^{-1ve}$ (kgf·m) | T.S. (kgf/mm²) | $Ac_3$ (°C.) | Plate Thickness (mm) | Calculation (×10³) | Remarks |
|---|---|---|---|---|---|---|---|---|---|---|---|---|---|---|---|---|
| 1 | 0.06* | 0.60 | 0.12 | 0.026 | 0.008 | 0.002 | 880 | 1 | 6800 | 5700 | 6.8 | 41.2 | 909 | 40 | 23.1 | Comparative |
| 2 | 0.006 | 0.21* | 0.09 | 0.009 | 0.007 | 0.002 | 880 | 1 | 9700 | 8200 | 21.4 | 24.4 | 905 | 20 | " | |
| 3 | 0.003 | 0.65 | 0.11 | 0.007 | 0.006 | 0.021* | 880 | 1 | 7100 | 6700 | 24.5 | 34.1 | 925 | " | " | |
| 4 | 0.006 | 0.62 | 0.72* | 0.006 | 0.003 | 0.004 | 880 | 1 | 4800 | 4400 | 10.7 | 40.6 | 911 | " | " | |

Note: *Outside the range of the present invention

What is claimed:

1. A magnetic steel plate for shielding magnetic flux which consists essentially of, by weight %:

C: not greater than 0.05%,

Si: greater than 0.30%, but not greater than 1.50%,

Mn: not greater than 0.50%, sol Al: less than 0.005%, with the balance being Fe and incidental impurities, the magnetic steel plate having a ferrite grain size number of 0 (zero) or smaller.

2. A magnetic steel plate for shielding magnetic flux as set forth in claim 1, wherein the C content is not greater than 0.01%.

3. A magnetic steel plate for shielding magnetic flux as set forth in claim 1, wherein the Si content is greater than 0.30% but not greater than 1.0%.

4. A magnetic steel plate for shielding magnetic flux which consists essentially of, by weight %:

C: not greater than 0.05%,

Si: greater than 0.30%, but not greater than 1.50%,

Mn: not greater than 0.50%, sol Al: less than 0.005%,

P: not greater than 0.10%,

S: not greater than 0.01%, Cr: 0–0.20%, Mo: 0–0.02%, Cu: 0–0.10%, Ni: 0–0.01%, Oxygen: 0–0.003%, with the balance being Fe and incidental impurities, the magnetic steel plate having a ferrite grain size number of 0 (zero) or smaller.

5. A magnetic steel plate for shielding magnetic flux as set forth in claim 4, wherein the C content is not greater than 0.01%.

6. A magnetic steel plate for shielding magnetic flux as set forth in claim 4, wherein the Si content is greater than 0.30% but not greater than 1.0%.

7. A magnetic steel plate for shielding magnetic flux as set forth in claim 1, wherein the magnetic steel plate has a magnetic flux density at 1 Oe ($B_1$) of at least 10,000 Gauss.

8. A magnetic steel plate for shielding magnetic flux as set forth in claim 1, wherein the magnetic steel plate has a tensile strength of at least 25 kgf/mm$^2$.

9. A magnetic steel plate for shielding magnetic flux as set forth in claim 1, wherein the magnetic steel plate has a maximum permeability ($\mu_{max}$) of at least 10,000.

10. A magnetic steel plate for shielding magnetic flux as set forth in claim 1, wherein the magnetic steel plate has a maximum permeability ($\mu_{max}$) of at least 30,000.

11. A magnetic steel plate for shielding magnetic flux as set forth in claim 4, wherein the magnetic steel plate has a magnetic flux density at 1 Oe ($B_1$) of at least 10,000 Gauss.

12. A magnetic steel plate for shielding magnetic flux as set forth in claim 4, wherein the magnetic steel plate has a tensile strength of at least 25 kgf/mm$^2$.

13. A magnetic steel plate for shielding magnetic flux as set forth in claim 4, wherein the magnetic steel plate has a maximum permeability ($\mu_{max}$) of at least 10,000.

14. A magnetic steel plate for shielding magnetic flux as set forth in claim 4, wherein the magnetic steel plate has a maximum permeability ($\mu_{max}$) of at least 30,000.

* * * * *